US005848633A

United States Patent [19]

Chou

[11] Patent Number: 5,848,633

[45] **Date of Patent: *Dec. 15, 1998**

[54] EXTRUSION TRACK FOR BLINDS

[76] Inventor: Tser-Wen Chou, 19464 Via Del Caballo, Yorba Linda, Calif. 92686

[ * ] Notice: The term of this patent shall not extend beyond the expiration date of Pat. No. 5,630,457.

[21] Appl. No.: 820,415

[22] Filed: Mar. 12, 1997

Related U.S. Application Data

[63] Continuation-in-part of Ser. No. 563,178, Nov. 27, 1995, Pat. No. 5,630,457.

[51] Int. Cl.[6] ..... E06B 9/30

[52] U.S. Cl. ..... 160/173 V; 160/900

[58] Field of Search ..... 160/173 V, 168.1 V, 160/172 V, 176.1 V, 178.1 V, 900, 38, 173 R, 178.1 R; 16/94 R, 95 R, 96 R

[56] References Cited

U.S. PATENT DOCUMENTS

| | | |
|---|---|---|
| 2,807,322 | 2/1957 | Toti . |
| 3,038,534 | 6/1962 | Clayton . |
| 3,068,938 | 12/1962 | Hull . |
| 4,103,727 | 8/1978 | Spohr . |
| 4,254,813 | 3/1981 | Vecchiarelli . |
| 4,291,738 | 9/1981 | Grenga et al. . |
| 4,316,493 | 2/1982 | Arena . |
| 4,335,775 | 6/1982 | Frentzel . |
| 4,869,309 | 9/1989 | Evans . |
| 4,919,185 | 4/1990 | Comeau et al. . |
| 4,921,031 | 5/1990 | Wagner et al. . |
| 5,630,457 | 5/1997 | Chou ..... 160/173 V |

FOREIGN PATENT DOCUMENTS

| | | |
|---|---|---|
| 0562711 | 9/1993 | European Pat. Off. . |
| 1698027 | 5/1955 | Germany . |
| 1803966 | 10/1968 | Germany . |
| 7129109 | 11/1971 | Germany . |
| 2031493 | 4/1980 | United Kingdom . |
| WO 9324726 | 12/1993 | WIPO . |

*Primary Examiner*—David M. Purol
*Attorney, Agent, or Firm*—Curtis L. Harrington

[57] ABSTRACT

The improved system utilizes a track (51) which has a bowed internal surface to prevent the wheel of the carrier (17) from frictional engagement with the side of the track (51). The curved surface (55) which faces the wheels (27) will not be engaged by the wheels (27) even where the carrier (17) turns to one side or the other. This is accomplished while leaving the innermost portions of the raceway (53) in the same width position with regard to the wheels (27) as is usual to prevent the carrier (17) from coming off-track. The tolerances for the inner corners of the raceway (53) opposing the wheels (27) may be reduced to further prevent the possibility of jamming in the track (51).

7 Claims, 3 Drawing Sheets

EXTRUSION TRACK FOR BLINDS

This is a continuation-in-part of U.S. patent application Ser. No. 08/563,178 filed on Nov. 27, 1995 now U.S. Pat. No. 5,630,457.

FIELD OF THE INVENTION

The present invention relates to the field of window coverings and more particularly for improvements in support track structures used for support and operation of blinds.

BACKGROUND OF THE INVENTION

Conventional support systems for blinds have included flat walled extrusions within which a carrier travels while supporting a wall covering member. In the case of vertical blinds, each carrier supports a vane in a particular orientation. The carrier provides the structure for controlling the orientation of the vane, as well as providing for the movement of the vane along the track. It is the track which has been formed as a flat walled extrusion within which the carrier must travel.

The carrier also rides about a vane orientation control rod which ideally lends no support to the vane. The rod is rotatable about its axis to operate a gear mechanism in the carriers to cause the vanes to change their angular position. The carriers further have an expandable and contractable connection with each other which enables the carriers to spread out to an optimum spacing when the blinds are covering the window, and move in to a close spacing when opened to uncover the window. This is usually controlled by a cord and is independent of the control for adjusting the angular position of the vanes.

The carrier usually consists of a rectangular member having a pair of side wheels for riding in the raceway of the extrusion. The wheels typically have a clearance with a vertical wall adjacent their outer radial surface. Although the carrier is not completely free to turn within the raceway of the extrusion, the needed relatively loose clearance enables the carrier to have some ability to turn.

Where the turning is sufficient, the wheels at their mid level height will contact and rub against the vertical wall of the extrusion. The friction generated by the rubbing of the wheel against the vertical wall is worsened since it has several components. First, the carrier is being dragged on both sides as it travels across the track. From one wheel the front mid level of the wheel is dragged and from the other the rear mid level of the wheel is being dragged.

Secondly, the wheels may still try to turn to the extent that they still engage the bottom race of the track by virtue of the weight of the vane. In essence, the wheel is being dragged against the vertical wall while it is still being turned by virtue of its contact with the bottom track of the raceway within which the wheel is supposed to fit. Thirdly, as the wheel is compressed against the vertical wall of the track on one side of the wheel, the other side of the wheel is jammed against the carrier, further impeding the ability of the wheel to turn.

Fourthly and most importantly, since the carrier has a relatively close width tolerance against the raceway, the turning of the carrier causes it to "jam" within the track. Where the carrier jams, a significant amount of width forces are exerted against the track. Where the forces are strong enough, such forces can cause failure in other structures within the track, and particularly with the structures which actuate movement of the carriers along the track.

Close tolerancing with regard to the wheels and the raceway in which they operate cannot be significantly compromised. An increase of the width of the wheels would make the system bulky, and would introduce further friction in the wheel design. Allowing too much play in the width would allow the wheels to ride from side to side, and would at worse enable the carrier to come off track and fall through the extrusion. Even though the vane angle control rod would prevent a total drop out, even a partial drop out would cause jamming or would place unacceptable pressures on the vane angle control rod.

In addition, an extrusion must be compact vertically in order to be able to serve a greater number of applications. In many cases, a small reduction in vertical height can result in an increased applicability over a wide range of potential application spaces.

What is therefore needed is a track which eliminates many of the problems associated with jamming and increased resistance to travel across the window. The needed system would compromise none of the advantages of the existing devices, yet offer more reliability and trouble-free operation, as well as being maximally compact, in order to be installable over a wide range of installation spaces.

SUMMARY OF THE INVENTION

The improved system utilizes a track which has a bowed internal surface to prevent the wheel of the carrier from frictional engagement with the side of the track. The curved surface which faces the wheels will not be engaged by the wheels even where the carrier turns to one side or the other. This is accomplished while leaving the innermost horizontal portions of the raceway in the same width position with regard to the wheels as is usual to prevent the carrier from coming off-track. If anything, the tolerances for the inwardly disposed corners of the raceway opposing the wheels may be reduced to further prevent the possibility of jamming in the track.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
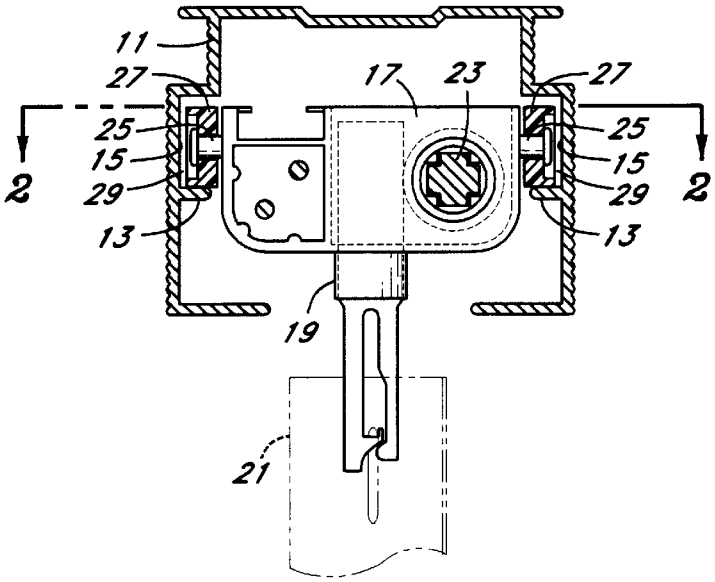
Fig. 1 (PRIOR ART)
FIG. 1 is an end sectional view transverse to the longitudinal axis of a conventional track and carrier and showing a sectional view taken through a carrier.

The description and operation of the invention will be best described with reference to a prior art configuration which shown in FIG. 1. A transverse end view illustrates a track 11 which is formed as a single extrusion. Track 11 may have various structures which permit it to be held in place, such as the two projecting structures at the top of the track 11. In side the main body of the track 11, a pair of interior raceways 13 project horizontally inward.

The raceways 13 are bounded by a vertical wall structure 15. Directly between the vertical wall structures 15 is a carrier 17. The carrier 17 supports a cylindrical member 19, which in turn supports a vane 21. The entire carrier 17 can slide longitudinally along the track 11 while it surrounds a control rod 23.

At the sides of the carrier 17 are a pair of axles 25, each of which supports a wheel 27. As is shown, the outer end of the axles 25 are enlarged to retain the wheels 27 on the axle. Note a clearance space 29 between the vertical walls 15 and the wheels 27. Although it would appear that the control rod 23 would keep the carrier 17 at the center of its raceway 13 path, the control rod is not laterally fixed within the track 11 along the mid point of its length and tends to be laterally displaced along with the carriers 17.

As can be seen in FIG. 1, the carrier can, during its travel within the track 11 move to the left or right causing one clearance space 29 to become reduced while the other clearance space 29 increases. At the extreme, the carrier 17 is operating all the way over to one side and rubbing against the vertical wall 15. Thus, the carrier 17 need not be off track or even jammed and it can increase the friction associated with movement by contact of a wheel 27 against the vertical wall 15. This situation is exacerbated where the control rod 23 is, for whatever reason, urging the carrier 17 forcibly to one side of the track 11. Regardless of the mechanism, the increased surface area of contact between the wheel 27 and the vertical wall 15 can cause the creation of enhanced frictional interference.

There is a relationship between the clearance 29 and the extent to which the width of the raceway 13 extends. An excess over the minimum amount of engagement of the wheel 27 by the raceway 13 must equal half of the total of the clearance 29 in order to account for the lateral drift of the carrier 17 as it proceeds along the track 11. As such, the clearance 29 is limited unless the raceways 13 are to be made wider. Wider raceways 13 would require a wider wheel 27 and a more substantial axle 25. This would increase the stress on the carrier 17 and increase the cost of the overall resulting system. Neither option is viable. In addition, an overall re-design of the carrier 17 is not an option. It is necessary to work with the existing carriers in the industry which already have a standard size dimension.

Figure 2:
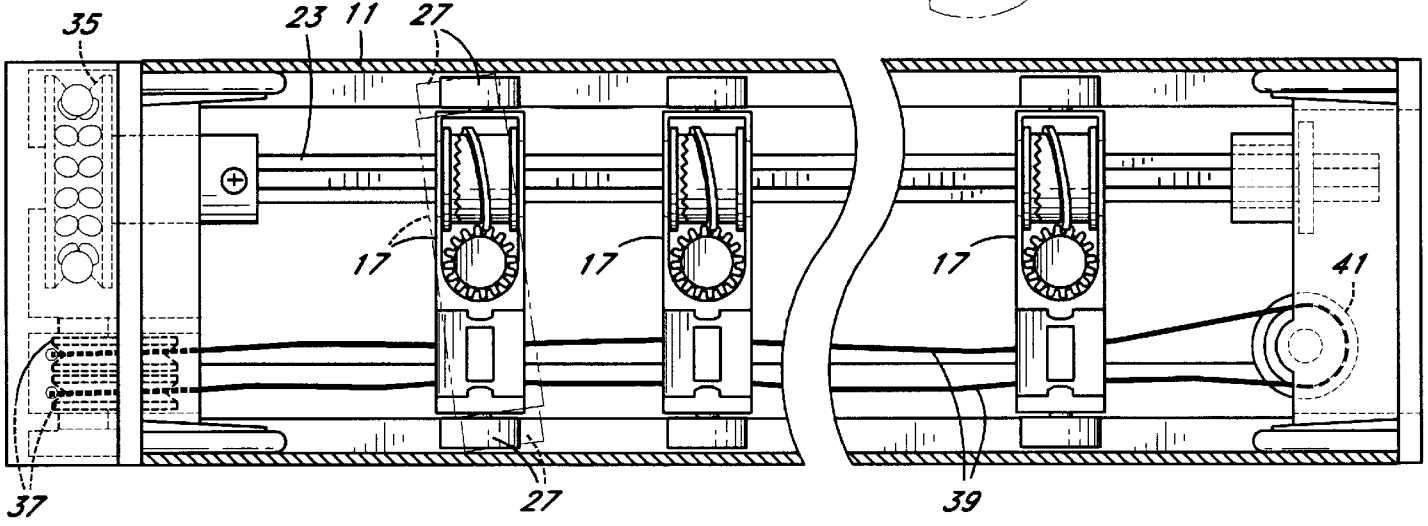
Fig. 2 (PRIOR ART)
FIG. 2 is a sectional view taken along line 2—2 of FIG. 1.

Referring to FIG. 2, further details of the track 11 and its associated components are seen. The track 11 contains a vane control pulley 35 which turns the control rod 23. The other end of control rod 23 is anchored at the other end of the track 11. A pair of rope pulleys 37 guide ropes 39 against a back pulley 41, to cause the carriers 17 to move across the track 11. As is shown in phantom by the carrier 17 closest to the pulleys 37, the carrier 17 can become twisted within the track 11 to cause jamming. Note that the edge of the wheel 27 of the carrier 17 has firmly engaged one side of the track 11, while another edge of the opposite wheel 27 has engaged the opposite side of the track 11.

This jamming condition puts resistance against the particular carrier 17, as well as on other structures. For example, the structures which spread the carrier 17 would be stressed if the jam occurred during closure, while the rope 39 would be stressed on opening. In FIG. 2, the worm gear mechanism can be seen which translates a turning of the control rod 23 into rotation of the cylindrical member 19.

Figure 3:
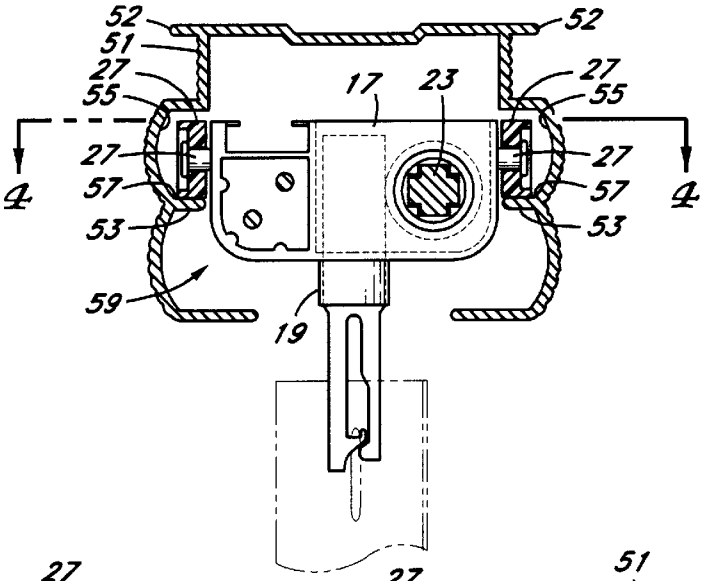
FIG. 3 is an end sectional view transverse to the longitudinal axis of the track and carrier of the present invention and showing a sectional view taken through the carrier.

Referring to FIG. 3, the present invention can be seen. A track 51 may also have various structures which permit it to be held in place, such as the two projecting structures 52 at the top of the track 51. In side the main body of the track 11, a pair of interior raceways 53 project horizontally inward.

The raceways 53, however, are bounded by a pair of internally curved wall structures 55. Although the internally curved wall structures 55 are also externally curved, this is not necessary and is incidental to the formation of the curved interior structure 55. Below the curved wall structures 55, the lower portion of the track 51 is also curved. This too is not necessary and is only done to complement and complete the structures 55 above.

The curvature of the wall structure 55 may range from a radial curvature of about 0.3 inches to about 0.6 inches. The preferred radius of curvature is about 0.4 inches and for one model has been set at 0.389 inches.

The carrier 17 and its associated structures are exactly as were shown in FIGS. 1 and 2, since the invention is designed to facilitate use with prior art carriers 17. Note that the wheels 27 ride on the top of the raceways 53 and that there exists a width of flat surface in between the outer edge of the wheels 27 and the beginning of the curved wall structure 55. This width is a horizontal clearance 57 and is approximately the same magnitude as the clearance 29 of FIG. 1. However, due to the curved structure 55, the outer face of the wheels 27 cannot contact the curved structures 55 beyond the point at which the horizontal clearance 57 meets the curved structures 55.

Therefore, even where the carrier 17 is forced to one side of the track 11, the wheel 27 cannot develop significant frictional area since the wall structure 55 is curved. If the carrier 17 becomes turned, the forward most rim of one wheel 27 and rearward most rim of the opposite wheel 27 cannot contact the curved wall structure 55. In fact, the curved wall structure 55 acts, in concert with the wheels 27 to produce forces which oppose any tendency of the carrier 17 to turn. In other words, for carrier 17 to turn, the wheels 27 would literally have to proceed angularly upwardly against the curved wall structure 55. This, depending upon the clearance 57, is either impossible or would be counter—opposed by gravity and the natural action of the wheels 27 on an internal curved surface, the curved wall structure 55.

Thus, the configuration described will enable a smaller clearance 57 while still giving reduced frictional interference. A smaller clearance 57 will enable a more exact tolerancing of the blind system and longer life.

Note also that the lower portion of the track 51 includes a lower chamber 59 defined by the bottom edge of the raceway 53 and the lower most ends of the track 51. The extended portion of track 51 which helps form the lower chamber 59 visually hides the inner workings of the vertical blind system.

Figure 5:
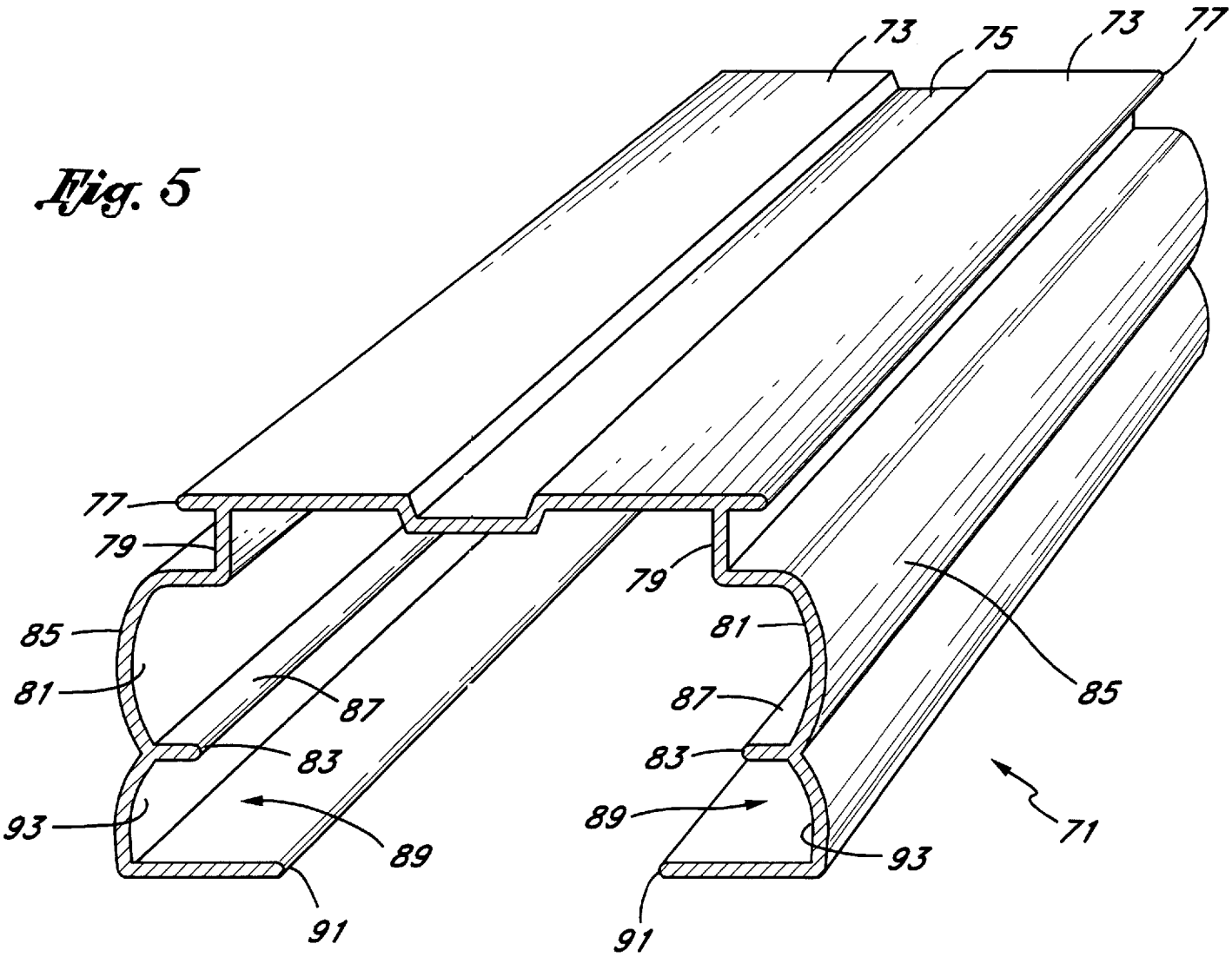
FIG. 5 is a perspective view of a second embodiment of the extrusion of the present invention.

Referring to FIG. 5, a vertically compact version of the present invention can be seen. A track 71 has a central upper horizontal planar portion 73 bisected by a centered depression 75. The outer edges of the planar portion have two elongate continuous projecting structures 77 at the top of the track 71. A pair of short vertical walls 79 continue from a point sufficiently axially to the center of the track 71 that the projecting structures 77 are allowed to be formed. From the bottom of the short vertical walls 79, a pair of internally curved wall structures 81 are suspended. At the base of the pair of internally curved wall structures 81, a pair of interior raceways 83 project horizontally inward.

The raceways 83 depend from and are bounded by the pair of internally curved wall structures 81. Although the internally curved wall structures 81 are also externally curved, forming externally curved wall structures 85, this is not necessary and is incidental to the formation of the curved interior structure 81. As has been previously discussed, the horizontal raceways 83 and their upper surfaces 87 form a junction with each of the pair of internally curved wall structures 81 to facilitate the free movement of wheels 27 and its carrier 17.

Figure 4:
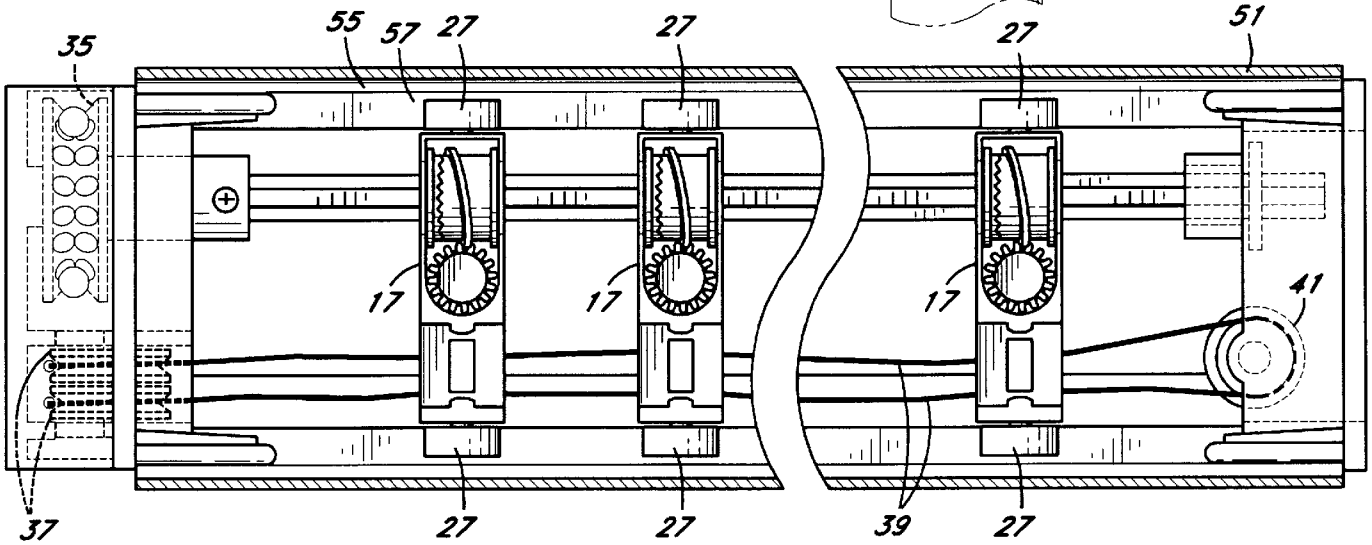
FIG. 4 is a sectional view taken along line 4—4 of FIG. 3.

Below the curved wall structures 81 and raceways 83 and externally curved wall structures 85, the track 71 continues downward. In the embodiment of FIGS. 3 and 4 continued the curving wall structure and this may have some additional advantage for use either with vertically longer carriers 17, or for visual symmetry as the lower chamber 59 was of the same general shape and bore some resemblence to the outer portion of the track 51 immediately above it.

However, for newer carriers 17 which are of abbreviated height, a bottom chamber 89 need not be as vertically long. One of the needs for the lower chamber is that its two horizontal closure portions 91 brought closely enough together to improve the appearance of the track 71, but not so closely together that the cylindrical member 19 of FIG. 1 would bind. In pulling the horizontal closure portions upward, a pair of vertically curved walls 93 have changed appearance from a curving shape having a maximum horizontal extent at its vertical middle, to a curving shape having a maximum horizontal extent at or immediately adjacent its vertically lower extent, or bottom. At this bottom, the horizontal closure portion 91 turns horizontally inward.

The curvature of the wall structure 81 may range from a radial curvature of about 0.3 inches to about 0.6 inches. The preferred radius of curvature is about 0.4 inches and for one model has been set at 0.389 inches. The height of the curved surface 81 is the same as for surface 55 at about 0.415 inches. The height of the lower chamber 89, between the bottom surface of the raceway 83 and the top surface of the horizontal closure portion 91 is about 0.27 inches. Each of the horizontal closure portions 91 is about 0.435 inches in horizontal length. The operation of the carrier 17 is the same as that described for FIGS. 3 and 4.

While the present invention has been described in terms of a vertical blind system, one skilled in the art will realize that the structure and techniques of the present invention can be applied to many similar appliances. The present invention may be applied in any situation where clearances can be reduced while at the same time reducing frictional engagement between components which would otherwise make frictional contact or cause jamming.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. An improved track (51) for vertical blinds comprising:

an elongate track (51) having an overall inverted "U" transverse shape having a pair of opposing lower ends, and including a pair of opposing raceways (53) each having an upwardly directed horizontal raceway surface and a downwardly directed horizontal raceway surface, said upwardly directed horizontal raceway surface and said downwardly directed horizontal raceway surface connected by a continuously curving internal wall (55) surface and wherein said track (51) includes a lower chamber (59) defined by the bottom edge of the horizontal raceway (53) and the lower most ends of the track (51) wherein the lower chamber (59), from the transverse perspective, has curved side walls and wherein said curved side walls each terminate at a maximum horizontal extent.

2. An improved vertical blind system including the improved track (51) of claim 1 and further comprising a carrier (17) having a pair of oppositely disposed wheels (27) for engagement upon said upper horizontal raceway surfaces of said horizontal raceways (53).

3. An improved track (51) for vertical blinds comprising:

an elongate track (51) having an overall inverted "U" transverse shape having a pair of opposing lower ends, and including a pair of opposing raceways (53) each having an upwardly directed horizontal raceway surface and a downwardly directed horizontal raceway surface, said upwardly directed horizontal raceway surface and said downwardly directed horizontal raceway surface connected by a continuously curving internal wall (55) surface and wherein said track (51) includes a lower chamber (59) defined by the bottom edge of the horizontal raceway (53) and the lower most ends of the track (51) and wherein said lower most ends of said track (71) extent toward each other to form a pair of horizontal closure portions (91).

4. An improved vertical blind system including the improved track (51) of claim 3 and further comprising a carrier (17) having a pair of oppositely disposed wheels (27) for engagement upon said upwardly directed horizontal raceway surfaces of said horizontal raceways (53).

5. The improved vertical track of claim 3 and further comprising a pair of spaced apart horizontal walls, each one of said pair of spaced apart horizontal walls extending from an associated one of said lower most ends of said track from said maximum horizontal extent and toward the other of said lower most end of said pair of spaced apart horizontal walls.

6. An improved track (51) for vertical blinds comprising:

an elongate track (51) having an overall inverted "U" transverse shape having a pair of opposing lower ends, and including a pair of opposing raceways (53) each having an upwardly directed horizontal raceway surface and a downwardly directed horizontal raceway surface, said upwardly directed horizontal raceway surface and said downwardly directed horizontal raceway surface connected by a continuously curving internal wall (55) surface and wherein said track (51) includes a vertical wall extending downwardly from the connection of said raceway to said continuously curving internal wall (55) surface at each said lower end.

7. The improved track of claim 6 wherein a horizontal wall extends from a lower end of each said vertical wall extending downwardly from the connection of said raceway in the direction of a center of the track.

* * * * *